United States Patent [19]

Jenison

[11] Patent Number: 4,546,946

[45] Date of Patent: Oct. 15, 1985

[54] COASTER WITH REMOVABLE SUPPORT PLATE

[76] Inventor: Richard B. Jenison, 48 Hill Top Dr., Cranston, R.I. 02920

[21] Appl. No.: 593,553

[22] Filed: Mar. 26, 1984

[51] Int. Cl.[4] ..... A47G 23/03

[52] U.S. Cl. ..... 248/346.1

[58] Field of Search ..... 248/346.1, 346

[56] References Cited

U.S. PATENT DOCUMENTS

| | | | |
|---|---|---|---|
| 777,305 | 12/1904 | Priestnall | 248/346.1 |
| 2,496,157 | 1/1950 | Gaudino | 248/346.1 |
| 3,120,077 | 2/1964 | Stoffel | 248/346.1 |
| 3,583,664 | 6/1971 | Kilina | 248/346.1 |
| 3,762,591 | 10/1973 | Gray | 248/346.1 |
| 3,808,084 | 4/1974 | Doty | 248/346.1 |
| 4,040,549 | 8/1977 | Sadler | 248/346.1 |

FOREIGN PATENT DOCUMENTS

| | | | |
|---|---|---|---|
| 322884 | 2/1903 | France | 248/346.1 |
| 993559 | 5/1965 | United Kingdom | 248/346.1 |

*Primary Examiner*—Reinaldo P. Machado
*Assistant Examiner*—Alvin Chin-Shue

[57] ABSTRACT

A coaster having a base member defining a cavity and an upwardly directed opening to the cavity, and a support plate removably mounted in the cavity so as to support a vessel on its exposed upper surface.

4 Claims, 2 Drawing Figures

COASTER WITH REMOVABLE SUPPORT PLATE

FIELD OF THE INVENTION

The invention relates to coasters.

BACKGROUND OF THE INVENTION

A coaster is well-known device for supporting a vessel such as a beverage glass on a table to protect the table surface.

SUMMARY OF THE INVENTION

I have discovered that by removably mounting a support plate for a vessel in a cavity of a base member of a coaster, one can remove the support plate and replace it with a support plate having a different exposed surface (e.g., one having a different design or different advertising).

In preferred embodiments the support plate has different opposite surfaces so that the plate can be reversed to provide different exposed upper surfaces; the base member has projections extending into an opening to the cavity, and the plate has corresponding notches adapted to pass by the projections without interference as the plate is moved through the opening and locked in the base member; there is an elongated support in the middle of the cavity for supporting the plate; and the base member has a pair of edge supports underneath the projections for supporting the plate near its edges.

DESCRIPTION OF THE PREFERRED EMBODIMENT

The structure and operation of the presently preferred embodiment of the invention will now be described after first briefly describing the drawings.

STRUCTURE

Figure 1:
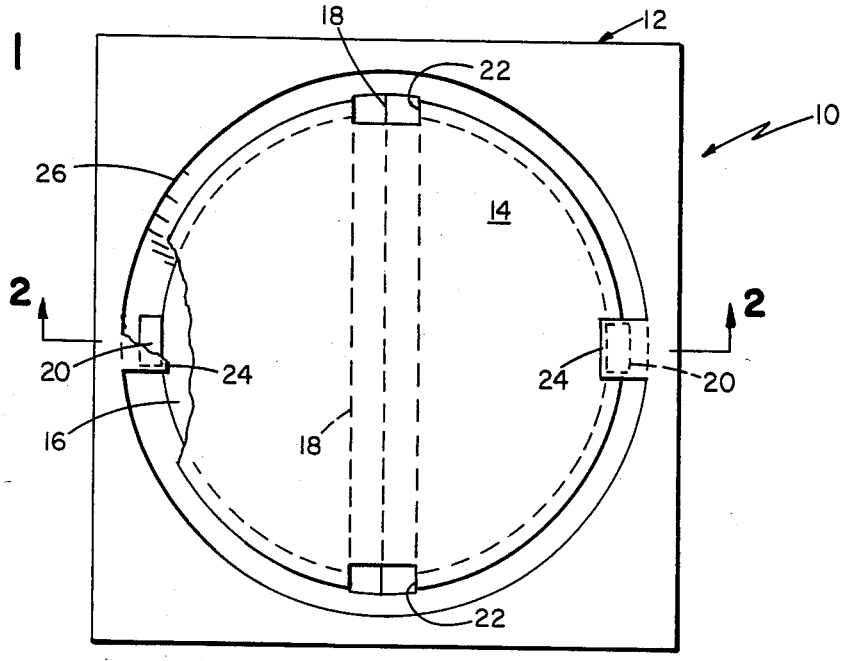
FIG. 1 is a plan view, partially broken away, of a coaster according to the invention.
Figure 2:
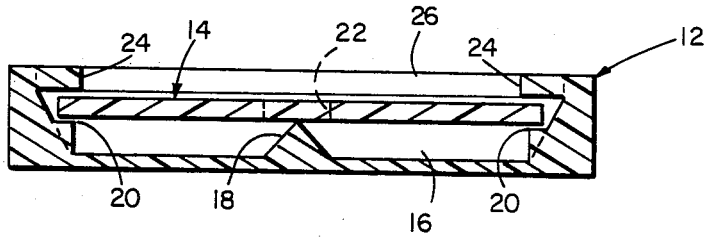
FIG. 2 is a vertical sectional view, taken at 2—2 of FIG. 1, of the FIG. 1 coaster.

Referring to FIGS. 1 and 2, there is shown coaster 10 having base member 12 and support plate 14 removably and rotatably mounted in cavity 16 of base member 12. Support plate 14 is supported by edge supports 20 and elongated support 18 extending across the middle of cavity 16. Support plate 14 has notches 22 adapted to pass by projections 24 of base member 12 extending into opening 26 of cavity 16. Support plate 14 carries different advertising on its upper and lower surfaces. Both base member 12 and support plate 14 are made of plastic, e.g., polycarbonate or polyester.

OPERATION

In use, support plate 14 is mounted in base member 12 by aligning notches 22 with projections 24, pushing plate 14 into cavity 16, and rotating plate 14 so that portions of plate 14 will be under projections 24 and interfere with removal of plate 14.

If it is desired to change the advertising exposed on the upper surface of plate 14, one merely removes plate 14 (by rotating it until notches 22 line up with projections 24 and lifting it out) and turns plate 14 over before remounting it in base member 12.

OTHER EMBODIMENTS

Other embodiments of the invention are within the scope of the following claims. For example, plate 14 need not have different opposite surfaces; a different plate 14 could be inserted into base member 12 in order to provide a different exposed surface. A circular rim may desirably be added at the top and bottom periphery of element 14, for cooperation with supports 20 to space the lower surface of element 14 away from support 18. Also, radial ribs may desirably be formed on the top and bottom of element 14 to facilitate rotation of that element relative to base member 12.

The removable construction greatly facilitates maintenance of cleanliness.

What is claimed is:

1. A coaster comprising a base member defining a circular cavity and an upwardly directed opening to said cavity, said base member having an elongated support extending only along a single axis through the center of said cavity and extending substantially across said cavity, a projection extending into said opening to said cavity at a location higher than said elongated support, and a pair of edge supports on opposite sides of said elongated support at the same height as said elongated support, and a support plate removably mounted in said cavity so as to support a vessel on its exposed upper surface, said plate being supported by said elongated support and said edge supports, said plate having a notch adapted to pass by said projection without interference as said plate is moved through said opening, said plate being mounted for rotatable movement when below said projection to move a portion of said plate under said projection so as to interfere with removal of said plate.

2. The coaster of claim 1 wherein said support plate has different opposite surfaces, whereby said plate can be reversed to provide a different exposed upper surface.

3. The coaster of claim 1 wherein there are two projections on opposite sides of said elongated support and two notches.

4. The coaster of claim 3 wherein said edge supports are located under said projections for supporting said plate near its edges.

* * * * *